United States Patent [19]

Hofmann et al.

[11] Patent Number: 4,936,217

[45] Date of Patent: Jun. 26, 1990

[54] SPLINTER BODY FOR FRAGMENTATION PROJECTILE

[75] Inventors: Gunther Hofmann, Leinburg; Siegfried Rhau; Adolf Weber, both of Neunkirchen, all of Fed. Rep. of Germany

[73] Assignee: Diehl GmbH & Co., Nuremberg, Fed. Rep. of Germany

[21] Appl. No.: 276,902

[22] Filed: Nov. 28, 1988

[30] Foreign Application Priority Data

Dec. 4, 1987 [DE] Fed. Rep. of Germany ..... 3741141

[51] Int. Cl.[5] ..... F42B 12/32

[52] U.S. Cl. ..... 102/496

[58] Field of Search ..... 102/482, 491, 494, 495, 102/496, 497, 524, 526, 527

[56] References Cited

U.S. PATENT DOCUMENTS

| | | | |
|---|---|---|---|
| 2,856,856 | 10/1958 | Michael | 102/524 |
| 2,996,012 | 8/1961 | Butler | 102/524 |
| 4,129,061 | 12/1978 | Bedall et al. | 102/496 |
| 4,296,180 | 10/1981 | Rhau et al. | 102/496 |
| 4,327,643 | 5/1982 | Barrias | 102/494 |
| 4,726,298 | 2/1988 | Sigg et al. | 102/527 |

FOREIGN PATENT DOCUMENTS

| | | |
|---|---|---|
| 0012323 | 12/1979 | European Pat. Off. . |
| 2606701 | of 1977 | Fed. Rep. of Germany . |
| 2852657 | 10/1984 | Fed. Rep. of Germany . |
| 2345697 | 3/1977 | France . |
| 501888 | 2/1971 | Switzerland . |

*Primary Examiner*—Harold J. Tudor

*Attorney, Agent, or Firm*—Scully, Scott, Murphy & Presser

[57] ABSTRACT

A fragment or splinter body for fragmentation projectiles, in which fragments which are in the shape of balls or spheroids are pressed intermediate two sleeves which are concentrically arranged within each other, whereby the outer sleeve is plastically formed into a recess which possesses the spheroids.

1 Claim, 1 Drawing Sheet

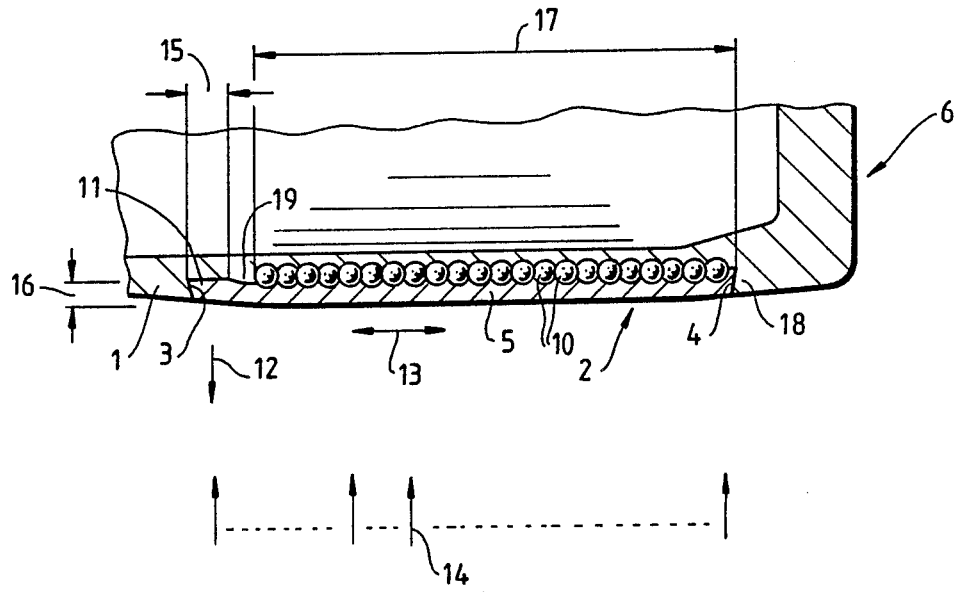
17
15
6
11
19
16
1
3
12
13
5
10
2
4
18
14

SPLINTER BODY FOR FRAGMENTATION PROJECTILE

BACKGROUND OF THE INVENTION

1. Field of the Invention

The present invention relates to a fragment or splinter body for fragmentation projectiles, in which fragments which are in the shape of balls or spheroids are pressed intermediate two sleeves which are concentrically arranged within each other, whereby the outer sleeve is plastically formed into a recess which possesses the spheroids.

2. Discussion of the Prior Art

From the disclosure of German Patent No. 28 52 657 there has become known an above-mentioned type of splinter body for fragmentation projectiles. Pursuant to manufacturing methods which have been employed to the present, the spheroids were applied onto the inner sleeve, the outer sleeve was slid thereover, and the outer sleeve was forged over along the length which was covered with the spheroids. During the production of the projectile casing from the above-mentioned forging, in order to be able to achieve the desired compacting between the two sleeves, welding seams had to be provided at the abutting joints at their end surfaces. These seams were only partially gas-tight, and needed to be sealed through an expensive after-treatment. Due to the leakiness or porosity of the seam, moisture entered into the region of the fragments, and due to the effects of corrosion adversely influenced the strength of the outer sleeve.

SUMMARY OF THE INVENTION

Accordingly, it is an object of the present invention to construct the contacting surfaces of the sleeves at their ends in such a manner as to ensure the outer sleeve being connected gas-tightly with the inner sleeve.

The foregoing invention attains this object in that the recess or cutout is constructed in a dove-tail configuration, and the outer sleeve has its applicable end surfaces contact along the full surface thereof under a relatively high pressure. In addition to inexpensive manufacture, a further advantage of the invention resides in that the forward connection at the end surface between the inner and outer sleeve is stable even for projectiles which are subjected to intense loads or forces.

Along this connecting location, at the high spin forces or for spinning projectiles in extensively long-range weapon barrels, there has heretofore been encountered a loosening of the outer sleeve, in that it projected beyond the contour of the projectile. As a consequence thereof, there was occasioned a significant variation in the hit or target striking position of the projectile.

BRIEF DESCRIPTION OF THE DRAWINGS

Reference may now be had to the following detailed description of an exemplary embodiment of the invention, taken in conjunction with the accompanying single figure of the drawing illustrating a fragmentary longitudinal sectional view through the fragmentation projectile.

DETAILED DESCRIPTION OF THE PREFERRED EMBODIMENTS

An inner sleeve 1 possesses a dove-tail shaped recess or cutout 2 with undercut end surfaces 3 and 4. The inner sleeve 1, in conjunction with the outer sleeve 5, forms a projectile body 6. Balls or spheroids 10 which are formed as fragments or splinters are positioned at forged in-between the inner sleeve 1 and the outer sleeve 5.

The compressive stresses in the outer sleeve 5, which are indicated by the arrow 13, are generated due to the forging along the direction of arrow 14 of the outer sleeve 5 against the inner sleeve 1, and produce a relatively high contact pressure against the end surfaces 3 and 4, so as to prevent the occurrence of any bulging out of the outer sleeve 5 or any loosening of a forward region 11 in the direction of the arrow 12.

At the end surface 3 facing towards the nose cone of the projectile, this is achieved through a separate deformation region 15 possessing a relatively extensive radial depth 16, as well as a sealing surface in the shape of the end surface 3. This is because in the region 11, relative to the projectile body 6, the wall thickness is thinner due to the nose cone than in the region of the end surface 4. Connected to the region of deformation 15 is a step 19 and a fragment region 17 with a step 18.

In the region 11, in order to improve upon the sealing action, a sealing ring can be forged in along the circumferential surfaces.

What is claimed is:

1. A splinter body for fragmentation projectiles, comprising:

two concentrically arranged sleeves including an inner and outer sleeve; and spheroidal fragments pressed between said two sleeves, said outer sleeve being plastically formed into a cutout in said inner sleeve, said cutout having a dove-tail shaped configuration, and said outer sleeve having respective end surfaces thereof in full surface contact with under cut end surfaces of said inner sleeve under a high pressure;

wherein said cutout includes a fragment receiving region bounded by steps for receipt of said spheroids; and said cutout further including, towards a nose cone of the projectile, a region of deformation having a large sealing surface.

* * * * *